US012778253B2

(12) United States Patent
Yao

(10) Patent No.: US 12,778,253 B2
(45) Date of Patent: Nov. 3, 2026

(54) SNAP-FIT DAMPER CARD BOX

(71) Applicant: Guangzhou Lixue Tongye Leather Co., Ltd, Guangdong (CN)

(72) Inventor: Lizhen Yao, Guangdong (CN)

(73) Assignee: Guangzhou Lixue Tongye Leather Co., Ltd, Guangdong (CN)

( * ) Notice: Subject to any disclaimer, the term of this patent is extended or adjusted under 35 U.S.C. 154(b) by 18 days.

(21) Appl. No.: 19/173,305

(22) Filed: Apr. 8, 2025

(65) Prior Publication Data

US 2026/0198666 A1 Jul. 16, 2026

(30) Foreign Application Priority Data

Jan. 15, 2025 (CN) ..... 202510059348.6

(51) Int. Cl.
*A45C 11/18* (2006.01)

(52) U.S. Cl.
CPC ..... *A45C 11/182* (2013.01)

(58) Field of Classification Search
CPC .... A45C 11/182; A45C 1/06; A45C 2001/065
USPC ..... 150/147
See application file for complete search history.

(56) References Cited

U.S. PATENT DOCUMENTS 1,415,276 A * 5/1922 Terner ..... G07B 3/04 220/DIG. 26
10,793,342 B2 * 10/2020 Minson ..... B65D 83/0829
11,344,091 B2 * 5/2022 Goodwin ..... A45C 13/1069
2015/0072549 A1 * 3/2015 Okoshi ..... G06K 13/0831 439/160
2018/0310681 A1 * 11/2018 Wingerter ..... B42F 17/32
2024/0049848 A1 * 2/2024 Du ..... A45C 11/182
2024/0277122 A1 * 8/2024 Huang ..... A45C 11/182
2024/0327099 A1 * 10/2024 Yu ..... A45C 11/182

FOREIGN PATENT DOCUMENTS

DE 202017105641 U1 * 12/2018 ..... A45C 11/182

OTHER PUBLICATIONS

Pop Up Wallets: https://www.allthewallets.com/best-pop-up-wallets/ (Year: 2025).*

* cited by examiner

*Primary Examiner* — Nathan J Jenness
*Assistant Examiner* — Justin Caudill
(74) *Attorney, Agent, or Firm* — Hawaii Patent Services; Nathaniel K. Fedde; Kenton N. Fedde

(57) ABSTRACT

The present disclosure provides a snap-fit damper card box, which comprises a box for storing cards and a mounting bracket located inside the box. The box is provided with an access port and a guide sidewall. The access port is used for the entry and exit of cards. The mounting bracket comprises an elastic strip that extends along the guide sidewall towards the access port and forms a slide groove with the guide sidewall. The elastic strip is provided with a first damping end close to the access port. The first damping end can move towards or away from the guide sidewall. A transmission rod capable of reciprocating sliding is arranged in the slide groove. The transmission rod has a compression end that is detachably abutted against the first damping end.

20 Claims, 8 Drawing Sheets

SNAP-FIT DAMPER CARD BOX

CROSS-REFERENCE TO RELATED APPLICATIONS

This application claims priority to the Chinese patent application No. 202510059348.6, titled "Snap-Fit Damper Card Box", filed on Jan. 15, 2025, the entire content of which, including the amendments thereof, is incorporated herein by reference in its entirety.

TECHNICAL FIELD

The present disclosure relates to the technical field of card boxes, and particularly relates to a snap-fit damper card box.

BACKGROUND

Cards are small rectangular items used to carry information or for entertainment, such as phone cards, postcards, ID cards, bank cards, etc. They are essential items in daily life. To facilitate carrying, people put cards into card boxes and take out the cards from the card boxes when using them.

The existing US patent with the publication number US20240407515A1 discloses a "Novel convenient ejection-type card box". This patent can clamp and fix the cards in the card box by setting an elastic sheet and utilizing the resilience and friction of the elastic sheet after the cards are inserted into the card box. However, when more cards are inserted into the card box, the cards will be subject to great friction, which makes it difficult to eject the cards in the card box and affects normal use.

Therefore, there is a need to propose a new type of card box to solve the above-mentioned problems.

SUMMARY

The present disclosure provides a snap-fit damper card box to solve the problems raised in the above background art.

In order to achieve the above disclosure object, the present disclosure adopts the following technical solutions:

A snap-fit damper card box includes a box for storing cards and a mounting bracket located inside the box. The box is provided with an access port and a guide sidewall, and the access port is configured for the entry and exit of cards. The mounting bracket comprises an elastic strip that extends along the guide sidewall towards the access port and forms a slide groove with the guide sidewall. The elastic strip is provided with a first damping end close to the access port, wherein the first damping end is capable of moving towards or away from the guide sidewall. The transmission rod capable of reciprocating sliding is arranged in the slide groove, wherein the transmission rod has a compression end that is detachably abutted against the first damping end. The compression end is abutted against the first damping end, the first damping end is squeezed away from the guide sidewall and elastically deformed.

The present disclosure further provides a snap-fit damper card box, which includes a box for storing cards and a mounting bracket located inside the box. The box is provided with an access port allowing cards to enter and exit, and a guide sidewall. The mounting bracket comprises an elastic strip and a support strip extending towards the access port, wherein the elastic strip and the support strip are separately arranged to form a clamping zone for clamping cards. The elastic strip is provided with a first damping end close to the access port, and the first damping end is capable of moving towards or away from the guide sidewall. One end of the clamping zone close to the access port is an open end, and when the first damping end approaches or moves away from the guide sidewall, a size of the open end is changeable. The elastic strip is arranged close to the guide sidewall with a gap between the elastic strip and the guide sidewall, wherein the gap is configured as a slide groove. A transmission rod capable of reciprocating sliding is arranged in the slide groove, wherein the transmission rod has a compression end, and the compression end is detachably abutted against the first damping end. When the compression end is abutted against the first damping end, the first damping end is squeezed away from the guide sidewall and elastically deformed, and the open end is narrowed.

BRIEF DESCRIPTION OF DRAWINGS

The drawings, which form a part of this application, are used to provide a further understanding of the present disclosure. The schematic embodiments of the present disclosure and the descriptions thereof are used to explain the present disclosure and do not constitute an improper limitation of the present disclosure. In the drawings.

Figure 1:
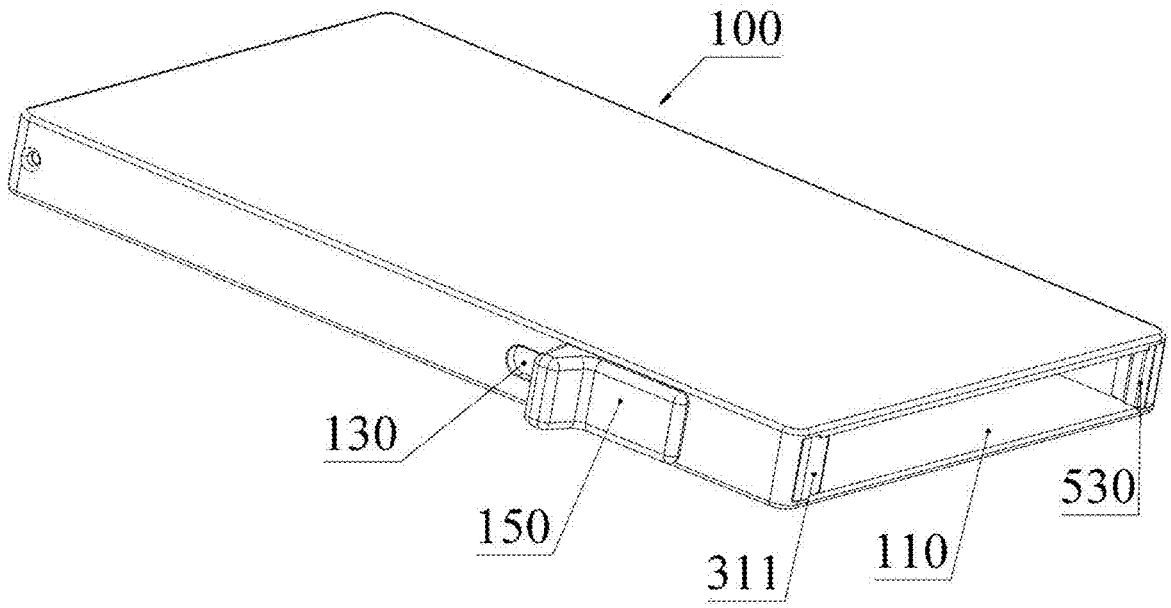
FIG. 1 is a schematic structural view of the present disclosure.

Reference signs: Box (100); Access port (110); Guide sidewall (120); Through slot (130); Slide groove (140); Slide button (150); Mounting bracket (200); Pivot shaft (210); Elastic strip (310); First damping end (311); First protrusion (312); Transmission rod (400); Compression end (410); Inclined surface (411); Transmission end (420); Second hook (421); Support strip (500); Flexible damper (510); First deformation zone (520); Second damping end (530); Second deformation zone (540); Clamping zone (600); Open end (610); Second protrusion (700); Swing arm (800); Stepped end (810); First hook (820); Return spring (900).

DESCRIPTION OF EMBODIMENTS

The technical solution in the embodiment of the present disclosure will be clearly and completely described below with reference to the drawings. Obviously, the described embodiment is part of, rather than all of the embodiments of the present disclosure. The following description of at least one exemplary embodiment is illustrative in nature and is in no way intended to limit the present disclosure, its application or uses. Based on the embodiments in the present disclosure, all other embodiments obtained by those skilled in the art without creative work belong to the scope of protection of the present disclosure.

It should be noted that the terminology used here is only for describing specific embodiments, and is not intended to limit exemplary embodiments according to the present application. As used herein, the singular form is also intended to include the plural form unless the context clearly indicates otherwise. Furthermore, it should be appreciated that when the terms "comprising" and/or "including" are used in this specification, they specify the presence of features, steps, operations, devices, components and/or combinations thereof.

Unless otherwise specified, the relative arrangement of components and steps, numerical expressions and numerical values set forth in these embodiments do not limit the scope of the present disclosure. At the same time, it should be appreciated that for the convenience of description, the dimensions of various parts shown in the drawings are not drawn according to the actual scale relationship. Techniques, methods and equipment known to those skilled in the art may not be discussed in detail, but in appropriate cases, they should be regarded as part of the authorization specification. In all the examples shown and discussed herein, any specific values should be interpreted as illustrative, and not as limiting. Therefore, other examples of exemplary embodiments may have different values. It should be noted that similar numbers and letters indicate similar items in the following drawings, therefore once an item is defined in one drawing, it does not need to be further discussed in subsequent drawings.

As shown in FIGS. 1 to 8, a snap-fit damper card box includes a box 100 for storing cards, and a mounting bracket 200 located inside the box 100. The box 100 is provided with an access port 110 and a guide sidewall 120. The access port 110 is used for the entry and exit of cards. The mounting bracket 200 includes an elastic strip 310. The elastic strip 310 extends along the guide sidewall 120 towards the access port 110, and forms a slide groove 140 with the guide sidewall 120. The elastic strip 310 is provided with a first damping end 311 close to the access port 110. The first damping end 311 can move towards or away from the guide sidewall 120. A transmission rod 400 capable of reciprocating sliding is provided in the slide groove 140. The transmission rod 400 has a compression end 410, and the compression end 410 is detachably abutted against the first damping end 311. When the compression end 410 is abutted against the first damping end 311, the first damping end 311 is squeezed away from the guide sidewall 120 and undergoes elastic deformation.

Figure 2:
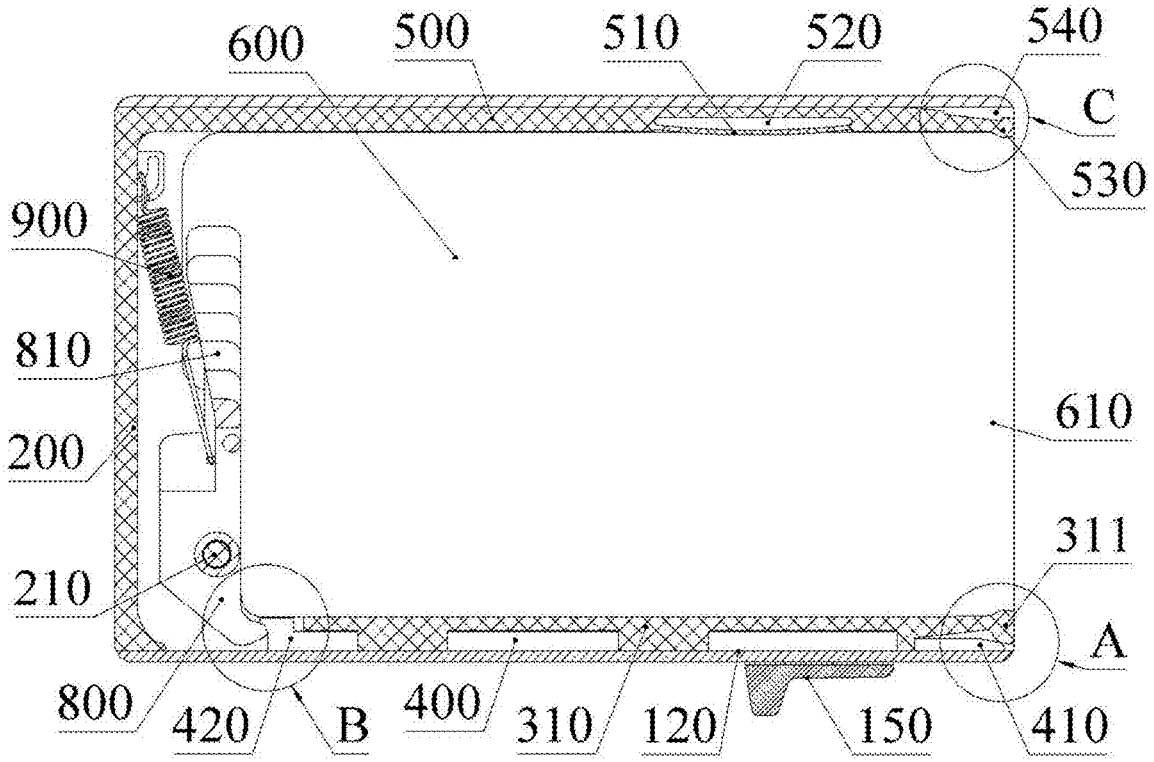
FIG. 2 is a schematic view of the internal structure of the present disclosure.
Figure 3:
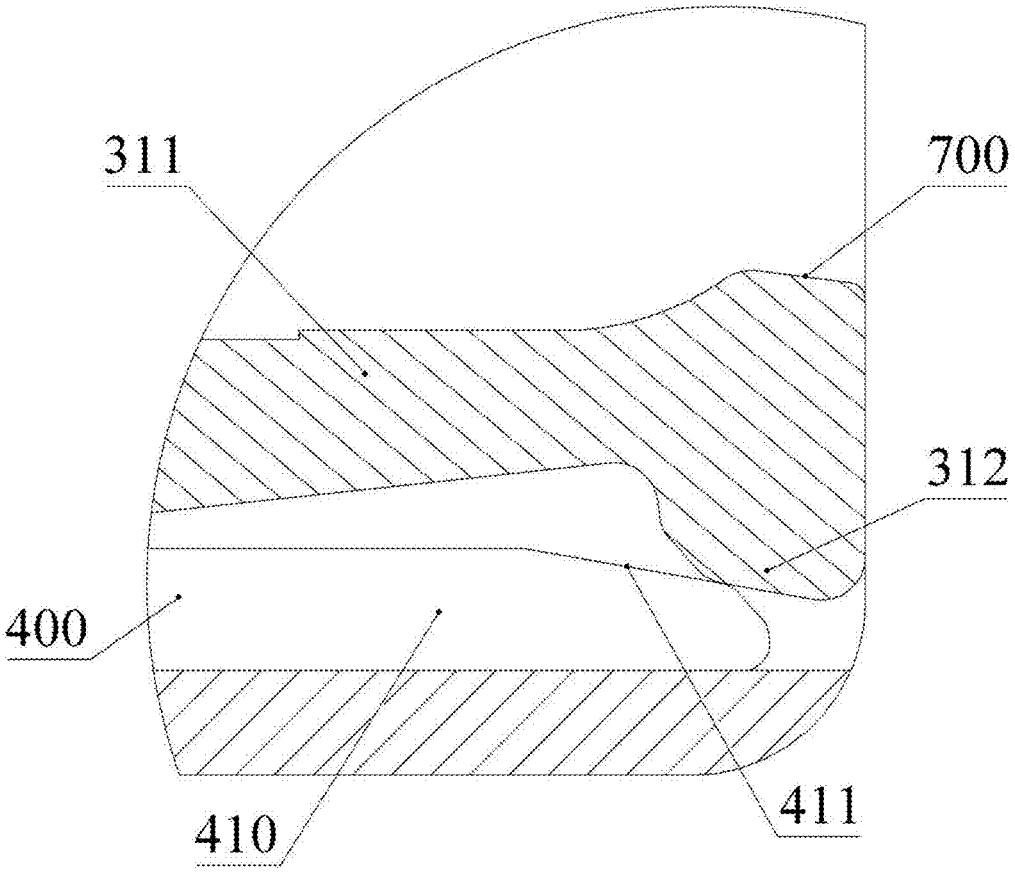
FIG. 3 is an enlarged schematic view of part A in FIG. 2.
Figure 6:
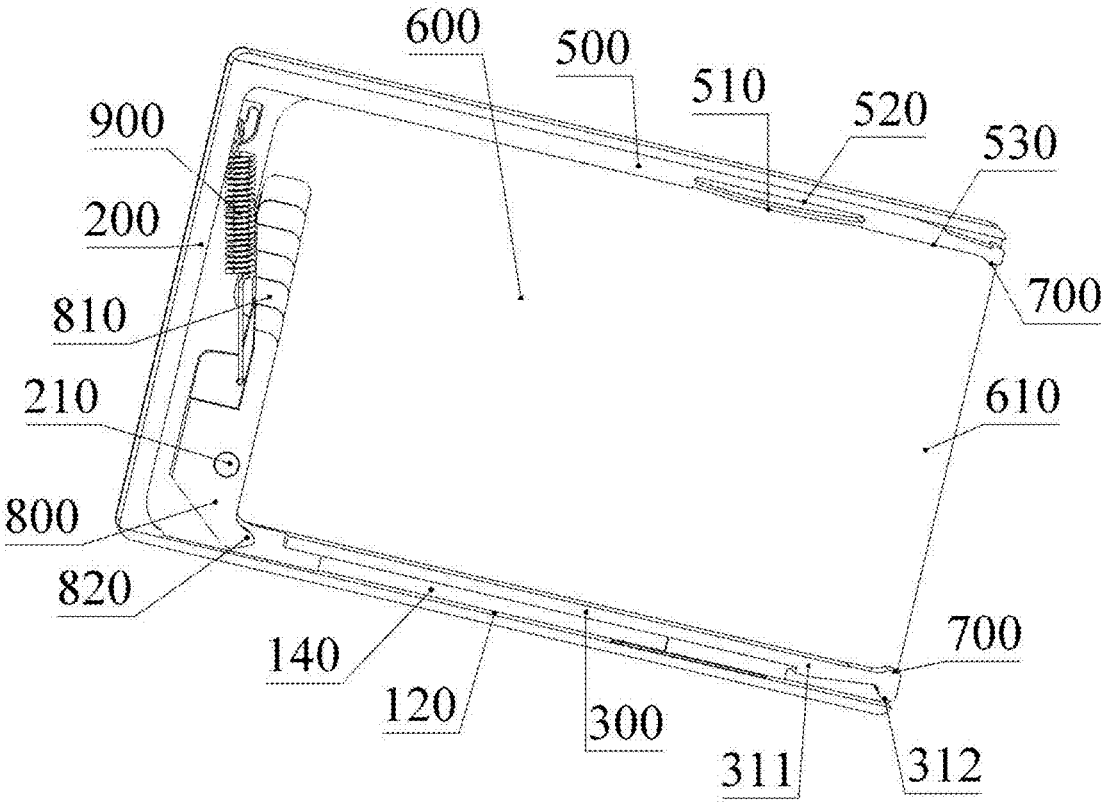
FIG. 6 is a schematic structural view of the present disclosure with the transmission rod removed.

Please refer to FIGS. 2 and 6. In this embodiment, when the first damping end 311 is squeezed by the compression end 410, it will undergo elastic deformation in the direction away from the guide sidewall 120, thereby applying a squeezing force to the card to fix the card inside the box 100. This prevents the card from being thrown out of the box 100 under the action of the squeezing force when the box 100 is shaken or swung, thus avoiding the situation of card loss.

Please refer to FIGS. 2, 3, 6, and 8. In this embodiment, the mounting bracket 200 also includes a support strip 500. The support strip 500 extends in the direction of the access port 110. The support strip 500 and the elastic strip 310 are arranged facing each other. The support strip 500 and the elastic strip 310 cooperate with each other to form a clamping mechanism, enabling the card to be firmly fixed inside the mounting bracket 200 and avoiding accidental falling off due to shaking or external force. A clamping zone 600 for clamping the card is formed between the support strip 500 and the elastic strip 310. The clamping zone 600 is used for clamping and fixing the card. One end of the clamping zone 600 close to the access port 110 is an open end 610. The card is inserted or taken out from the open end 610. When the first damping end 311 is close to the guide sidewall 120, the width of the open end 610 is slightly larger than the width of the card, ensuring that the card can smoothly slide out of the access port 110. When the card is inserted and fixed in the clamping zone 600, the first damping end 311 is away from the guide sidewall 120, so that the width of the open end 610 is slightly smaller than the width of the card, and a certain squeezing force is applied to the card to fix it in the clamping zone 600, avoiding accidental falling off due to shaking or external force.

Figure 7:
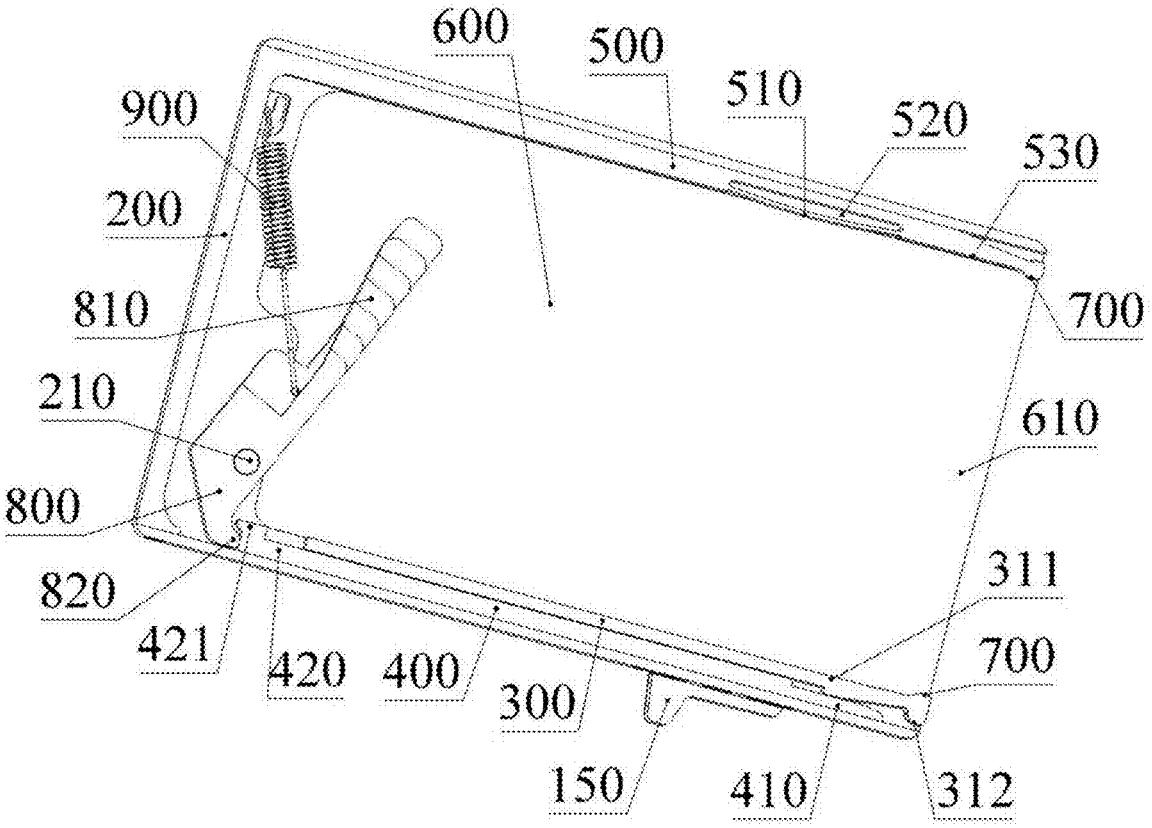
FIG. 7 is a schematic view of the state of the present disclosure when taking out a card.
Figure 8:
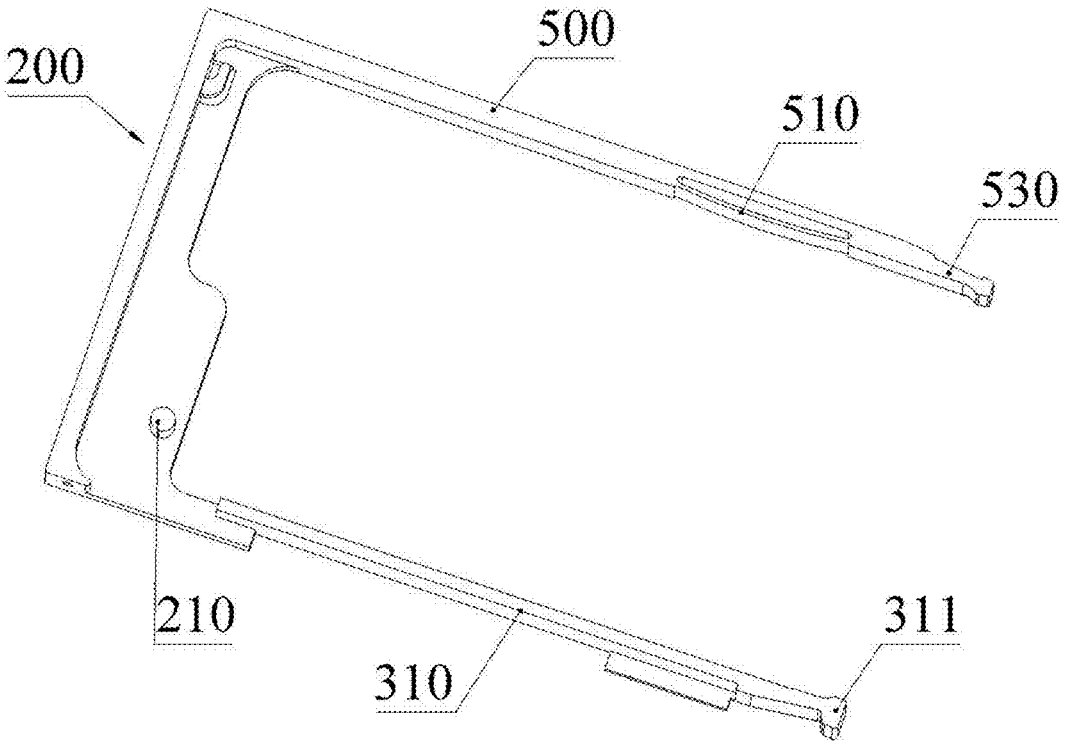
FIG. 8 is a schematic structural diagram of the mounting bracket (200) of the present disclosure.

Please refer to FIGS. 2, 7, and 8. In this embodiment, one end of the mounting bracket 200 opposite to the open end 610 is pivotally connected to a swing arm 800. The swing arm 800 is provided with a stepped end 810. The swing arm 800 is pivotally connected to the mounting bracket 200 through a pivot shaft 210. The swing arm 800 can swing around the pivot shaft 210 on the mounting bracket 200. The transmission end 420 of the transmission rod 400 in and the stepped end 810 of the swing arm 800 are respectively located on opposite sides of the pivot shaft 210. The stepped end 810 is sequentially provided with multiple steps, and each step corresponds to a card storage position, so that when the card is placed in the clamping zone 600, there is a corresponding position for it. In order to ensure that the cards can all correspond to the corresponding steps, the height of the steps is the same as or slightly higher than the thickness of the cards, and the width spacing between the steps is the same. There is no specific limit on the number of steps, and the number of steps can be designed according to actual needs. In this embodiment, the number of steps is six.

Please refer to FIGS. 2 and 7. In this embodiment, a return spring 900 is installed between the swing arm 800 and the mounting bracket 200. One end of the return spring 900 is hooked to a position on the mounting bracket 200 close to the support strip 500, and the other end is hooked to a position on the stepped end 810 of the swing arm 800 close to the pivot shaft 210. When the swing arm 800 swings around the pivot shaft 210 in the direction of the access port 110, it will be pulled back to its preset position after the swing of the swing arm 800 is completed.

In another embodiment (not shown), the setting of the return spring 900 can be cancelled. A return torsion spring is sleeved on the pivot shaft 210. One end of the return torsion spring is fixed on the mounting bracket 200 or the pivot shaft 210, and the other end is installed on the swing arm 800. When the swing arm 800 swings around the pivot shaft 210, the torsion spring will generate a corresponding torsional moment, so that the swing arm 800 can be reset to the preset position after the action is completed. Using the return torsion spring makes the structure more compact and improves the reliability and stability of the card box during use.

Figure 4:
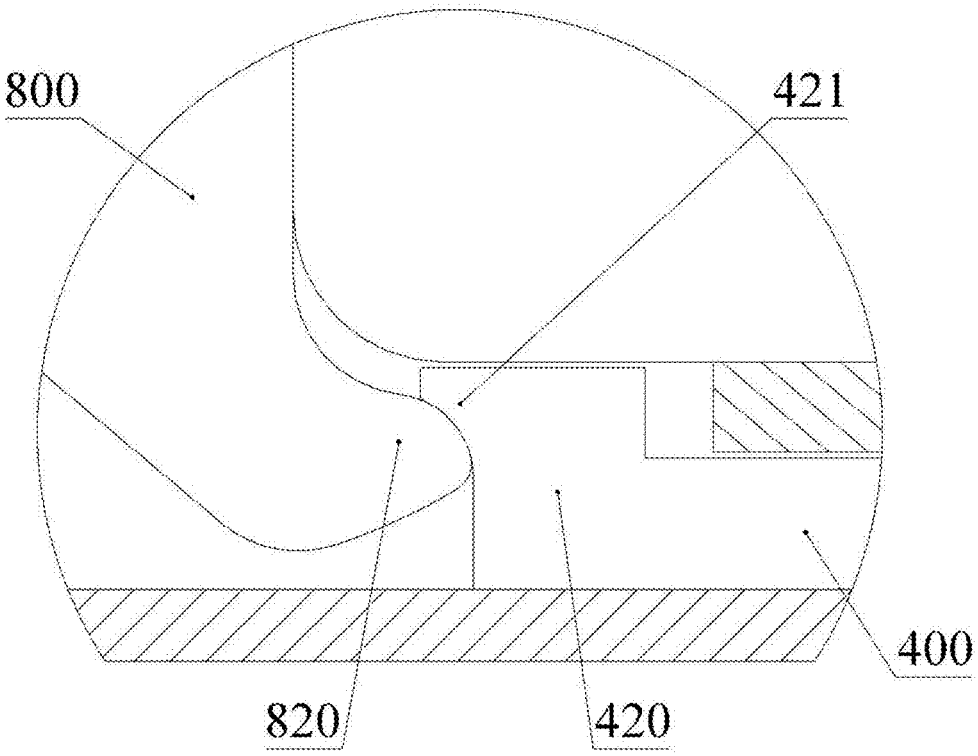
FIG. 4 is an enlarged schematic view of part B in FIG. 2.
Figure 5:
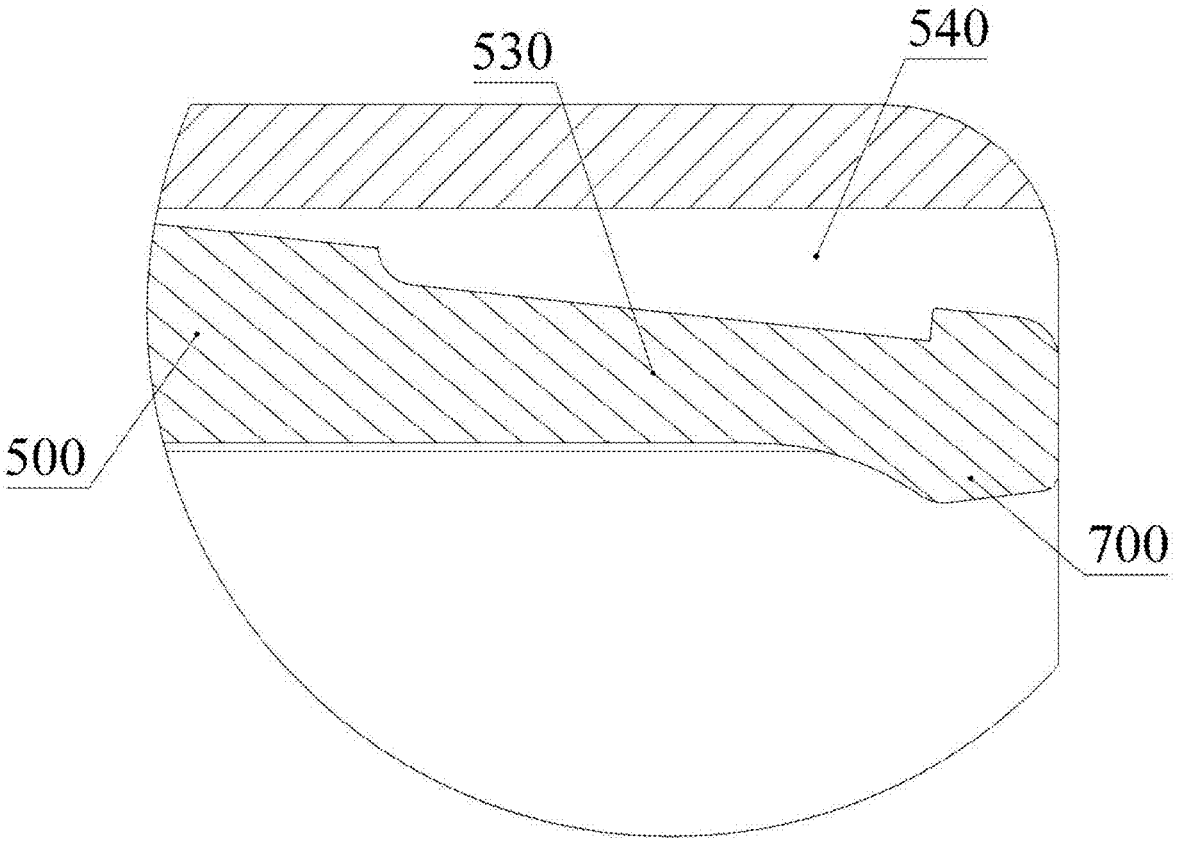
FIG. 5 is an enlarged schematic view of part C in FIG. 2.

Please refer to FIGS. 2 and 4. In this embodiment, the transmission rod 400 also has a transmission end 420 extending towards the swing arm 800. The transmission end 420 is movably abutted against the swing arm 800, so as to realize flexible and stable force transmission between the two. The transmission end 420 is provided with a first hook 820, and the swing arm 800 is correspondingly provided with a second hook 421. The first hook 820 and the second hook 421 are hooked to each other. With this hooking structure, the transmission end 420 and the swing arm 800 can be linked, so as to realize the transmission of force.

In another embodiment (not shown), the transmission rod 400 and the swing arm 800 can also be rotationally connected through a rotating shaft to form a link structure, thereby realizing the transmission of force. The link structure enables the transmission rod 400 to drive the swing arm 800 to swing around the rotating shaft when subjected to force, making the movement of the swing arm 800 more stable and controllable. At the same time, it can reduce the wear that may be caused by direct abutment or hooking connection, and improve the durability and reliability of the overall device.

Please refer to FIGS. 2 and 6. In this embodiment, a flexible damper 510 is provided on one side of the support strip 500 facing the clamping zone 600. A first deformation zone 520 that allows the flexible damper 510 to elastically deform is provided between the flexible damper 510 and the support strip 500. The support strip 500 and the flexible damper 510 are integrally formed using an ABS material. When the card is stored in the box 100, the card will squeeze the flexible damper 510, and the flexible damper 510 will undergo elastic deformation towards the first deformation zone 520. In this way, the flexible damper 510 will exert a certain squeezing force on the card to fix the card in the clamping zone 600 and prevent it from shaking.

In addition, the flexible damper 510 also plays a buffering role to prevent the card from being thrown out of the box 100 due to excessive swinging force of the swing arm 800. The flexible damper 510 improves the overall stability of the box 100 by enhancing the damping effect.

In other embodiments (not shown), the flexible damper 510 can also be provided on the elastic strip 310, or the flexible damper 510 can be provided on both the elastic strip 310 and the support strip 500. The flexible damper 510 can be designed according to actual needs.

Please refer to FIGS. 2 to 6. In this embodiment, the first damping end 311 is provided with a first protrusion 312 facing the guide sidewall 120. The first damping end 311 and the first protrusion 312 are integrally formed using an ABS material. The compression end 410 is provided with an inclined surface 411 that slidably cooperates with the first protrusion 312. When the transmission rod 400 slides towards the access port 110, guided by the inclined surface 411, the first protrusion 312 is squeezed by the compression end 410 and gradually undergoes elastic deformation in a direction away from the guide sidewall 120, thereby changing the size of the open end 610 of the clamping zone 600. When the card box is not in use, the compression end 410 abuts against the first protrusion 312, keeping the first damping end 311 in an elastically deformed state. A second damping end 530 is provided at a position of the support strip 500 close to the open end 610. A second protrusion 700 is provided on one side of the first damping end 311 and the second damping end 530 facing the open end 610. The second protrusions 700 of the first damping end 311 and the second damping end are both integrally formed using an ABS material. The structure of the second protrusion 700 is similar to a buckle, and they all protrude a certain distance towards the clamping zone 600, thereby clamping the card in the clamping zone 600 to prevent the card from falling and getting lost. There is a gap between the second damping end 530 and the box 100. The gap is configured as a second deformation zone 540 that allows the second damping end 530 to elastically deform. When the card is inserted or removed, the second damping end 530 is squeezed by the card and undergoes elastic deformation towards the second deformation zone 540, thereby providing appropriate damping force, which can ensure the stable storage of the card and prevent it from accidentally sliding out due to external forces.

In another embodiment (not shown), the positions of the inclined surface 411 and the first protrusion 312 can be interchanged. For example, the first protrusion 312 is provided on the transmission rod 400, and the inclined surface 411 is provided on the first damping end 311. When the transmission rod 400 slides, it can also push the first damping end 311 to deform.

In other embodiments (not shown), the elastic strip 310, the support strip 500, the first damping end 311, the second damping end 530, and the flexible damper 510 can also be made of other elastic materials, such as plastics with good resilience and strength, like PC, PP, PS, PEEK, etc., which can still maintain good plasticity and resilience after repeated long-term use; elastic steel can also be used, which has better durability. The specific material can be selected according to actual needs.

Please refer to FIGS. 1 and 6. In this embodiment, the guide sidewall 120 is provided with a through slot 130 communicating with the slide groove 140. A slide button 50 is arranged outside the box 100. A part of the slide button 150 passes through the through slot 130 and is clamped with the transmission rod 400. Users can directly adjust the position of the transmission rod 400 by sliding the slide button 150, so as to perform the operation of accessing cards.

Working principle: when in use, the card is aligned with the access port 110 to be inserted into the box 100 and when the card enters the clamping zone 600, it will push the flexible damper 510 to make it elastically deform; the flexible damper 510 exerts a moderate squeezing force on the card, and after the card is inserted, the first damping end 311 and the second protrusion 700 on the second damping end 530 will clamp the card to prevent it from falling out of the box 100; when the card needs to be used, the slide button is pushed to slide downward, and the slide button drives the transmission rod 400 to slide downward; the transmission end 420 presses the swing arm 800 downward, the swing arm 800 swings around the pivot shaft 210 towards the access port 110, and the return spring 900 is stretched; at this time, the compression end 410410 is disengaged from the first protrusion 312, and the first damping end 311 moves towards the guide sidewall 120; when the swing arm 800 swings around the pivot shaft 210 towards the access port 110, the stepped end 810 pushes the card out of the clamping part; the steps of the stepped end 810 will push out the cards in order one by one; the spacing between each step will make the ejection height of each card distributed in a stepped manner, which is convenient for taking different cards; and when the card is ejected, it will squeeze the second damping end 530, and the second damping end 530 will elastically deform towards the second deformation zone 540; at the same time, the flexible damper 510 continues to work, effectively preventing the swing arm 800 from exerting excessive force on the card and throwing the card out of the box 100; after the cards are taken out, the slide button is released; the elastic force of the return spring 900 will reset the swing arm 800 without any external force, and when the swing arm 800 resets, it will drive the transmission rod 400 and the slide button to reset together; finally, the card is manually pushed back into the card box to complete the access operation.

In summary, as can be seen from the above description, the present disclosure achieves the following technical effects: with the clamping structure of the support strip 500 and the elastic strip 310, it is ensured that the card will not shake after being inserted; the second protrusions 700 are provided at the first damping end 311 and the second damping end 530 to clamp cards inside the card box 100, and even if the box 100 is shaken or impacted, the cards can be effectively prevented from loosening or being lost; moreover, a flexible damper 510 is provided on the elastic strip 310, which provides a moderate buffering effect when accessing the card, preventing the swing arm 800 from swinging too strongly and throwing the card out of the box 100; multiple steps are sequentially provided on the stepped end 810 of the swing arm 800, which can effectively support the distribution of multiple cards when pushing out multiple cards and ensure that the cards can be pushed out sequentially and orderly. Compared with traditional card boxes, it has significant improvements in anti-falling, convenient access, structural stability, and durability, and can be widely applied to various scenarios where cards need to be stored.

In the description of the present disclosure, it should be appreciated that directional terms such as "front, rear, up, down, left, right", "horizontal, vertical, perpendicular, horizontal" and "top, bottom" etc. indicate the orientation or positional relationship based on the orientation or positional relationship shown in the drawings, and are only for the convenience of describing the present disclosure and simplifying the description. In the absence of a contrary explanation, these directional terms do not indicate or imply that the device or element referred to must have a specific orientation or be constructed and operated in a specific orientation, and therefore should not be understood as limiting the scope of protection of the present disclosure; the directional terms "inside, outside" refer to the inside and outside relative to the contour of each component itself.

For the convenience of description, spatial relative terms such as "on . . . ", "above . . . ", "on the upper surface of . . . ", "upper" etc. may be used here to describe the spatial positional relationship of a device or feature with other devices or features as shown in the drawings. It should be appreciated that spatial relative terms are intended to encompass different orientations of the device in use or operation other than the orientation described in the drawings. For example, if the device in the drawing is inverted, the device described as "above other devices or structures" or "on other devices or structures" will subsequently be positioned as "below other devices or structures" or "under other devices or structures". Thus, the exemplary term "above" can include both "above" and "below" orientations. The device can also be positioned in other different ways (rotated 90 degrees or in other orientations), and the spatial relative descriptions used here should be interpreted accordingly.

In addition, it should be noted that the use of terms such as "first", "second" etc. to define components is for the convenience of distinguishing the corresponding components. Unless otherwise stated, the above terms have no special meaning, and therefore should not be understood as limiting the scope of protection of the present disclosure.

The above description is only a preferred embodiment of the present disclosure and is not intended to limit the present disclosure. For those skilled in the art, the present disclosure can have various modifications and changes. Any modifications, equivalent replacements, improvements etc. made within the spirit and principles of the present disclosure should be included within the scope of protection of the present disclosure.

What is claimed is:

1. A snap-fit damper card box, comprising a box (100) for storing cards and a mounting bracket (200) located inside the box (100), wherein the box (100) is provided with an access port (110) and a guide sidewall (120), and the access port (110) is configured for the entry and exit of cards; and the mounting bracket (200) comprises an elastic strip (310) that extends along the guide sidewall (120) towards the access port (110) and forms a slide groove (140) with the guide sidewall (120); and the elastic strip (310) is provided with a first damping end (311) close to the access port (110), wherein the first damping end (311) is capable of moving towards or away from the guide sidewall (120); and a transmission rod (400) capable of reciprocating sliding is arranged in the slide groove (140), wherein the transmission rod (400) has a compression end (410) that is detachably abutted against the first damping end (311); and when the compression end (410) is abutted against the first damping end (311), the first damping end (311) is squeezed away from the guide sidewall (120) and elastically deformed.

2. The snap-fit damper card box according to claim 1, wherein the mounting bracket (200) further comprises a support strip (500) extending towards the access port (110), the support strip (500) is arranged opposite to the elastic strip (310), and a clamping zone (600) for clamping cards is formed between the support strip (500) and the elastic strip (310).

3. The snap-fit damper card box according to claim 2, wherein one end of the clamping zone (600) close to the access port (110) is an open end (610), and when the first damping end (311) approaches or moves away from the guide sidewall (120), a size of the open end (610) is changable.

4. The snap-fit damper card box according to claim 3, wherein one end of the mounting bracket (200) opposite to the open end (610) is pivotally connected with a swing arm (800), and a stepped end (810) is provided on the swing arm (800).

5. The snap-fit damper card box according to claim 4, wherein a return spring (900) is installed between the swing arm (800) and the mounting bracket (200).

6. The snap-fit damper card box according to claim 4, wherein the transmission rod (400) further has a transmission end (420) extending towards the swing arm (800), and the transmission end (420) is movably abutted against the swing arm (800).

7. The snap-fit damper card box according to claim 6, wherein the transmission end (420) and the swing arm (800) are respectively provided with a first hook (820) and a second hook (421), and the first hook (820) and the second hook (421) are hooked with each other.

8. The snap-fit damper card box according to claim 6, wherein the swing arm (800) is pivotally connected with the mounting bracket (200) through a pivot shaft (210), and the transmission end (420) and the stepped end (810) are respectively located on opposite sides of the pivot shaft (210).

9. The snap-fit damper card box according to claim 2, wherein a flexible damper (510) is provided on one side of the support strip (500) facing the clamping zone (600), and a first deformation zone (520) allowing the flexible damper (510) to elastically deform is provided between the flexible damper (510) and the support strip (500).

10. The snap-fit damper card box according to claim 1, wherein the first damping end (311) is provided with a first protrusion (312) facing the guide sidewall (120), and the compression end (410) is provided with an inclined surface (411) that is in sliding fit with the first protrusion (312).

11. The snap-fit damper card box according to claim 1, wherein the guide sidewall (120) is provided with a through slot (130) communicating with the slide groove (140), a slide button (150) is provided outside the box (100), and part of the slide button (150) passes through the through slot (130) and is clamped with the transmission rod (400).

12. A snap-fit damper card box, comprising a box (100) for storing cards and a mounting bracket (200) located inside the box (100), wherein the box (100) is provided with an access port (110) allowing cards to enter and exit, and a guide sidewall (120); and the mounting bracket (200) comprises an elastic strip (310) and a support strip (500) extending towards the access port (110, wherein the elastic strip (310) and the support strip (500) are separately arranged to form a clamping zone (600) for clamping cards; and the elastic strip (310) is provided with a first damping end (311) close to the access port (110), and the first damping end (311) is capable of moving towards or away from the guide sidewall (120); and one end of the clamping zone (600) close to the access port (110) is an open end (610), and when the first damping end (311) approaches or moves away from the guide sidewall (120), a size of the open end (610) is changable; and the elastic strip (310) is arranged close to the guide sidewall (120) with a gap between the elastic strip (310) and the guide sidewall (120), wherein the gap is configured as a slide groove (140); and a transmission rod (400) capable of reciprocating sliding is arranged in the slide groove (140), wherein the transmission rod (400) has a compression end (410), and the compression end (410) is detachably abutted against the first damping end (311); and when the compression end (410) is abutted against the first damping end (311), the first damping end (311) is squeezed away from the guide sidewall (120) and elastically deformed, and the open end (610) is narrowed.

13. The snap-fit damper card box according to claim 12, wherein the first damping end (311) is provided with a first protrusion (312) facing the guide sidewall (120), and the compression end (410) is provided with an inclined surface (411) that is in sliding fit with the first protrusion (312).

14. The snap-fit damper card box according to claim 12, wherein a flexible damper (510) is arranged on one side of the support strip (500) facing the clamping zone (600), and a first deformation zone (520) that allows the flexible damper (510) to elastically deform is arranged between the flexible damper (510) and the support strip (500).

15. The snap-fit damper card box according to claim 12, wherein a second damping end (530) is arranged at a position of the support strip (500) close to the open end (610), and second protrusions (700) are arranged on the sides of both the first damping end (311) and the second damping end (530) facing the open end (610).

16. The snap-fit damper card box according to claim 15, wherein there is a gap between the second damping end (530) and the box (100), and the gap is configured as a second deformation zone (540) that allows the second damping end (530) to elastically deform.

17. The snap-fit damper card box according to claim 12, wherein one end of the mounting bracket (200) opposite to the open end (610) is pivotally connected with a swing arm (800), a stepped end (810) is provided on the swing arm (800), and a return spring (900) is installed between the swing arm (800) and the mounting bracket (200).

18. The snap-fit damper card box according to claim 17, wherein the transmission rod (400) further has a transmission end (420) extending towards the swing arm (800), and the transmission end (420) is movably abutted against the swing arm (800).

19. The snap-fit damper card box according to claim 18, wherein the transmission end (420) and the swing arm (800) are respectively provided with a first hook (820) and a second hook (421), and the first hook (820) and the second hook (421) are hooked with each other.

20. The snap-fit damper card box according to claim 19, wherein the swing arm (800) is pivotally connected with the mounting bracket (200) through a pivot shaft (210), and the transmission end (420) and the stepped end (810) are respectively located on opposite sides of the pivot shaft (210).

* * * * *